US005480044A

United States Patent [19]

Nosser

[11] Patent Number: 5,480,044

[45] Date of Patent: Jan. 2, 1996

[54] SAFETY CAP

[76] Inventor: Steven E. Nosser, 3400 Armstrong Dr., Wichita Falls, Tex. 76304

[21] Appl. No.: 281,085

[22] Filed: Jul. 27, 1994

[51] Int. Cl.[6] ..... B65D 41/04

[52] U.S. Cl. ..... 215/228; 220/212; 220/376; 215/386; 215/353

[58] Field of Search ..... 215/100 A, 100 R, 215/226, 228, 301, 303, 353, 386; 220/212, 255, 376; 81/3.07, 3.08, 3.09, 3.15, 3.4, 3.42

[56] References Cited

U.S. PATENT DOCUMENTS

| | | | |
|---|---|---|---|
| 2,641,943 | 6/1953 | Krize, Jr. | 81/3.4 |
| 3,159,298 | 12/1964 | Saw | 215/228 |
| 3,402,843 | 9/1968 | Campbell | 215/100 R |
| 4,150,761 | 4/1979 | Collins | 215/228 |
| 4,273,247 | 6/1981 | Earls | 215/228 |
| 4,616,759 | 10/1986 | Mahler | 215/228 |
| 4,702,129 | 10/1987 | Allen | 81/3.09 |
| 4,760,763 | 8/1988 | Trick et al. | 81/3.09 |
| 4,766,781 | 8/1988 | Grise et al. | 81/3.4 |
| 4,903,848 | 2/1990 | Chattman | 215/227 |
| 5,088,611 | 2/1992 | Katz | 215/230 |
| 5,101,870 | 4/1992 | Farris | 141/343 |
| 5,181,632 | 1/1993 | Latter . | |
| 5,190,532 | 3/1993 | Yu . | |
| 5,328,069 | 7/1994 | Cohanfard | 224/148 |

*Primary Examiner*—Stephen J. Castellano
*Attorney, Agent, or Firm*—Sixbey, Friedman, Leedom & Ferguson

[57] ABSTRACT

A safety cap for a dispenser shaped to prevent choking thereof, particularly in small children. Specifically, the cap includes a lid portion including an attachment portion for securing the cap to the dispenser, and a flange portion extending radially from a lower portion of the lid portion to prevent the cap from becoming a choking hazard when removed from the dispenser. The flange portion is also shaped to complement a corresponding portion of the dispenser. Preferably, the flange portion is shaped to extend from the lid portion of the cap at an obtuse angle therefrom wherein the dispenser includes an upper surface which is also at the same angle. The safety cap of the present invention may also include a rotational assistance member which is attachable to the lid portion of the cap for frictionally engaging the flange portion.

7 Claims, 3 Drawing Sheets

SAFETY CAP

BACKGROUND OF THE INVENTION

1. Technical Field of the Invention

The present invention relates to a safety cap particularly advantageous for children which is designed to prevent the cap from becoming a choking hazard. More particularly, the present invention relates to a safety cap designed for children which prevents the cap from becoming a choking hazard, while also permitting a child to use the cap more easily than conventional caps.

2. Description of the Prior Art

Children begin at a young age to imitate adults and attempt to perform tasks that adults perform. Such activity permits the child to mature and develop independent skills. It also exposes the child to many potential dangers. One of these dangers involves opening and closing containers or dispensers in which the container has a small lid or cap. If the cap is small enough, the child could place it in his or her mouth creating a choking hazard. For instance, the cap for a tube of toothpaste is very small and cone-like which can be easily swallowed by a child and lodged in the throat.

In addition to the potential choking hazards associated with dispenser caps, many conventional caps are difficult to open by the small hands of a child due to their small size. Without assistance from an adult, a child cannot open many dispensers or bottles that contain substances which are not harmful to a child, and, thus, are available for a child's use and development. This required assistance reduces the child's development skills and independent activities.

Consequently, there is a need for a cap which can be used by children and which does not create a choking hazard. Further, with this increased safety, there is a need for a cap which can be easily handled and manipulated by a child in order to assist in the development of skills, such as eye-hand coordination.

SUMMARY OF THE INVENTION

Therefore, it is an object of the present invention to overcome the shortcomings associated with the prior art and to provide a safe and child useable cap for a dispenser or container.

Another object of the present invention is to provide a safety cap for a dispenser shaped to prevent choking.

Yet another object of the present invention is to provide a safety cap which can be easily opened and closed by a child.

Still another object of the present invention is to provide a safety cap for a dispenser shaped to prevent choking including a lid portion and a flange portion extending radially therefrom wherein the flange portion is shaped to correspond to the shape of an upper portion of the dispenser for which it is used.

Yet another object of the present invention is to provide a safety cap for a dispenser shaped to prevent choking including a lid portion and a flange portion extending radially therefrom wherein the flange portion is shaped to correspond to the upper portion of the dispenser for which it is used and further including a rotational assistance device which is attachable to the lid portion of the cap wherein the rotational assistance device is made of a flexible material for providing a easily handled grip and for frictionally engaging the flange portion of the cap and, thus, assisting in the opening and closing of the dispenser.

These, as well as other advantages of the present invention, are achieved by providing a safety cap for dispenser or container shaped to prevent choking thereof, particularly by small children. Specifically, the cap includes a lid portion for matingly engaging a portion of the dispenser and a flange portion extending radially from a lower portion of the lid portion. The flange portion extends radially to a distance sufficient to prevent the cap from becoming a choking hazard when removed from the dispenser. The flange portion is also shaped to complement a corresponding portion of the dispenser. Preferably, the flange portion is shaped to extend from the lid portion of the cap at an obtuse angle therefrom to match an upper surface of the dispenser present at the same angle. The safety cap of the present invention may also include a rotational assistance member which is attachable to the lid portion of the cap for frictionally engaging the flange portion and for providing a larger, easily handled grip for use by a child.

DETAILED DESCRIPTION OF THE INVENTION

The present invention generally relates to a cap for a container or dispenser which is safe for a child to use. Specifically, the cap is shaped to prevent the cap from becoming a choking hazard. The present invention is particularly useful for caps which are conventionally small, such as the cap for a toothpaste dispenser. The cap of the present invention may also include a rotational assistance member which matingly receives a portion of the cap. The rotational assistance member is bulbous in shape, and, thus, larger than the cap itself to provide a greater amount of gripping area for a child.

Figure 1:
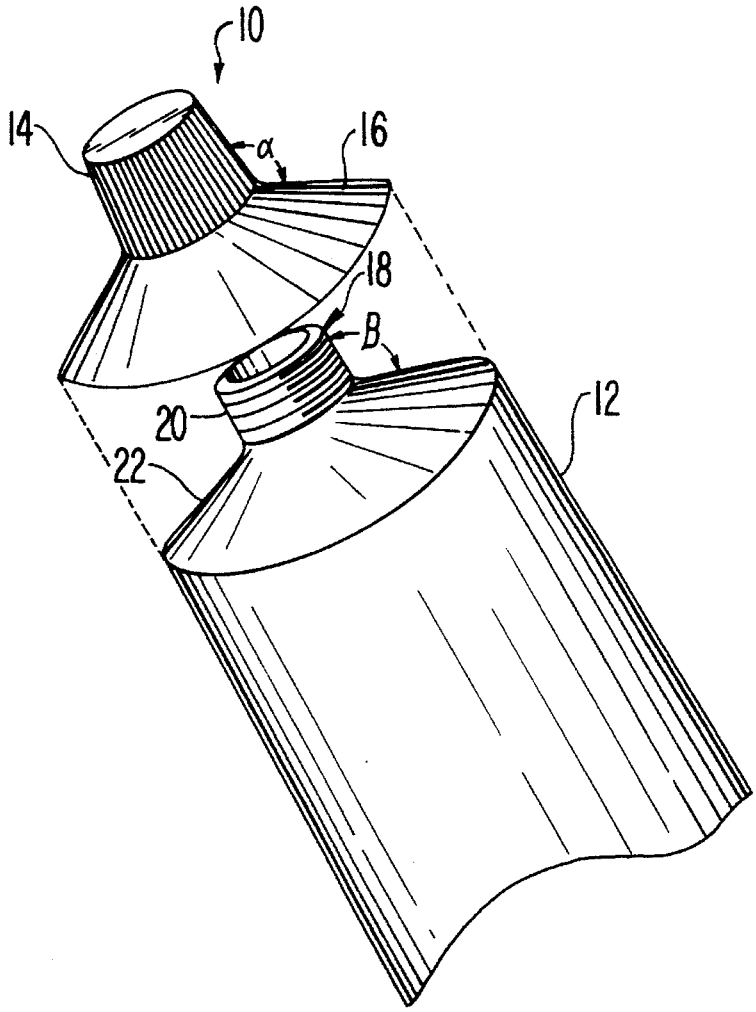
FIG. 1 is a perspective view of the cap of the present invention adjacent a corresponding dispenser in a disengaged position.

With reference to the drawings, safety cap 10 is illustrated. FIG. 1 shows safety cap 10 prior to engagement with a toothpaste dispenser 12. Although a toothpaste dispenser is shown, it is only for illustration purposes. The safety cap of the present invention is equally applicable to any dispenser or container.

Safety cap 10 includes a lid portion 14 and a radial flange 16 extending therefrom. Dispenser 12 may include a central column portion 18 adapted to be matingly received by lid portion 14. Lid portion 14 includes an attachment member for engaging central column portion 18. As shown in FIG. 1, central column portion 18 may include external threads 20 which threadingly engage internal threads 21 located on an internal wall of lid portion 14. These internal threads 21 are clearly shown in FIG. 5–7 discussed below. Threading engagement is but one example of the many possible attachment types encompassed by the present invention, such as pop-off or flip-off lids.

Flange portion 16 is shaped to prevent cap 10 from becoming a choking hazard if a child places the cap in his or her mouth. Preferably, flange portion 16 extends radially from lid portion 14 wherein the diameter of flange portion 16 is at least 1¼ inches. By extending flange portion 16 to a sufficient extent, the cap becomes large enough to make it very difficult to swallow, particularly by a small child. Flange portion 16 is shown as a circular flange in FIGS. 1–7, but could be any desired shape.

Not only does flange portion 16 prevent cap 10 from becoming a choking hazard, the flange portion also provides many other advantages not heretofore available by conventional caps.

Even for adults, a conventional cap, such as a toothpaste dispenser cap, can be difficult to replace due to its relatively small size, particularly, in view of the small size of the internal passage of the cap. For a child, replacement of the cap can cause extreme frustration and may create quite a mess as the result of immature hands squeezing the dispenser too hard during replacement. As clearly shown in FIG. 1, flange portion 16 extends at an obtuse angle $\alpha$ from lid portion 14. Such an angle makes it much easier for a child to replace the cap on the dispenser after use by providing a much larger area for capturing central column portion 18 of the dispenser 12. Because flange portion 16 extends at an obtuse angle with respect to lid portion 14, column portion 18 is guided into engagement with the attachment member of cap 10.

Angle $\alpha$ is also designed to conform to the upper surface 22 of dispenser 12. Specifically, upper surface 22 conventionally extends from central column portion 18 at an obtuse angle 13. Flange portion 16 of cap 10 is preferably designed such that angle $\alpha$ is substantially equal to angle $\beta$. This feature is more clearly shown in FIGS. 5–7 discussed in detail below.

Conforming flange portion 16 to the shape of upper surface 22 provides many benefits. First, the seal provided between cap 10 and dispenser 12 is enhanced by maintaining a seal therebetween not only at column portion 18, but also along upper surface 22. In addition, by extending flange portion 16 at least as far and the outer radial extent of upper surface 22, excess toothpaste which commonly accumulates around the column portion 18 is shielded by the flange to avoid mess.

Second, the total cost of manufacturing the dispenser may be reduced. Most conventional dispensers, particularly toothpaste dispensers, include a deformable lower portion containing the toothpaste and a rigid or semi-rigid upper surface 22. The lower portion is made of a material that can be deformed to force toothpaste out of the dispenser. The upper surface is more rigid so that the pressure created inside the dispenser will force the toothpaste out rather than merely against the upper surface. Further, the rigid nature of the upper surface is desired to provide at least some structural integrity to the dispenser.

Cap 10 of the present invention is preferably made from a rigid material, such as plastic. As a result, flange portion 16 of cap 10 acts like a shield over the upper surface 22, which, in turn, provides structural integrity to the dispenser 12. By providing flange portion 16 substantially over the entire upper surface 22 of dispenser 12, package manufacturers are permitted to design dispenser 12 with a less rigid upper surface, and, thus, reduce the materials costs associated with the production of these dispensers.

Figure 2:
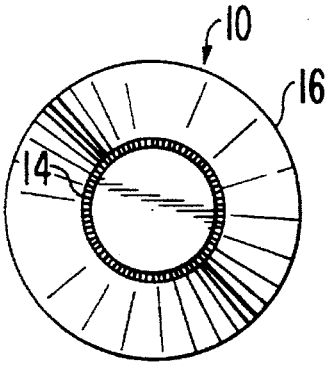
FIG. 2 is top view of the cap of the present invention.
Figure 3:
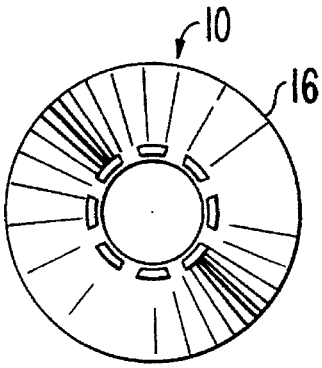
FIG. 3 is a bottom view of the cap of the present invention.

FIGS. 2 and 3 provide upper and lower views, respectively, of safety cap 10 of the present invention.

Figure 4:
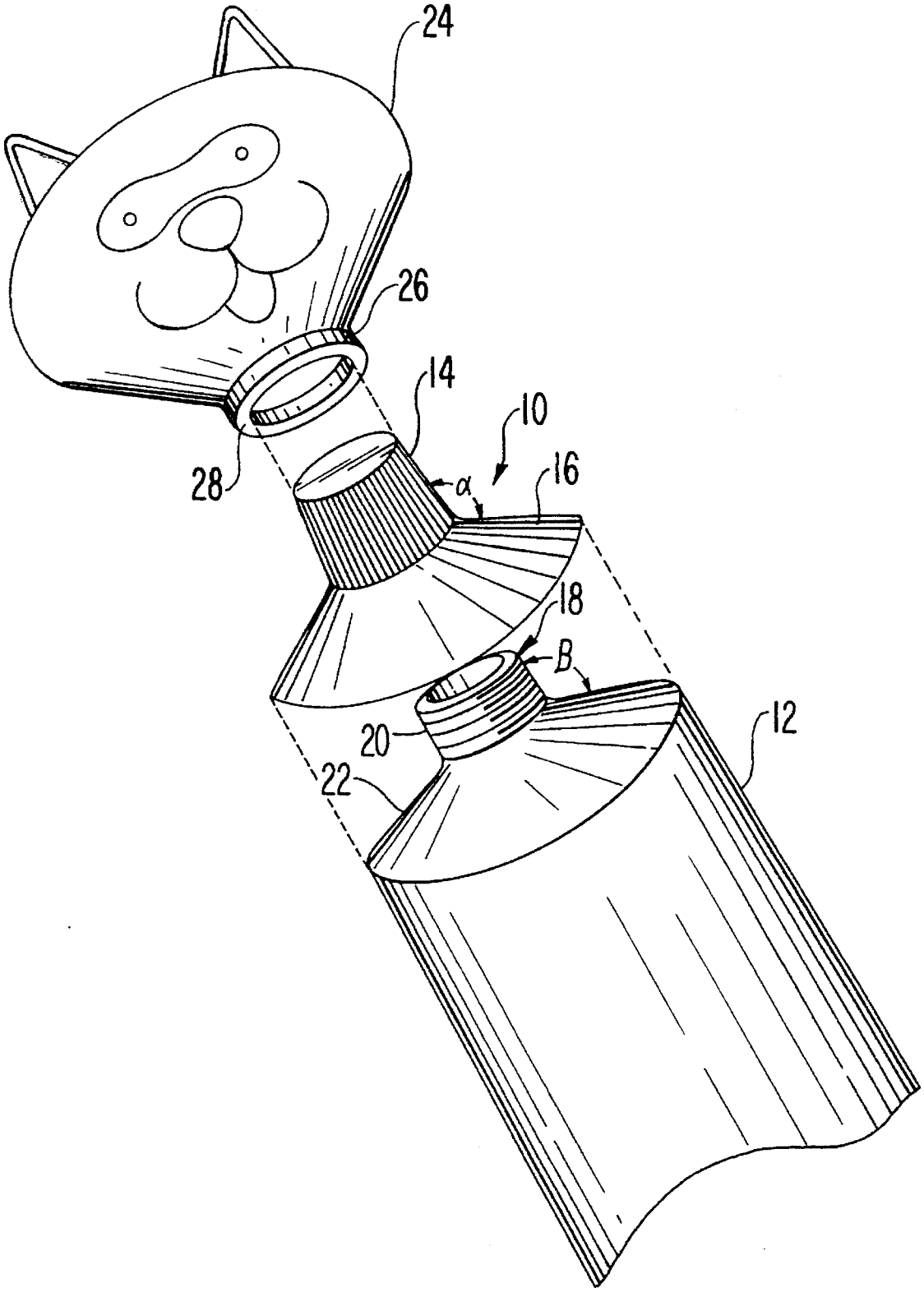
FIG. 4 is a perspective view of the cap of the present invention including a rotational assistance member.

The present invention may also include a rotational assistance member 24. FIG. 4 illustrates the rotational assistance member 24 prior to engagement with lid portion 14 of cap 10. Rotational assistance member 24 is preferably a bulbous member made of a resilient material. The bulbous size makes it substantially larger than lid portion 14, and, thus, much more grippable by the small hand of a child. Moreover, the resilient nature of the material from which it is made allows a child to squeeze member 24 to provide even further assistance in opening and closing dispenser 12. As a result, a child is given the opportunity to open and close his or her own container, and thereby further develop skills, such as eye-hand coordination.

Rotational assistance member 24 includes a ring 26 at the base thereof which is shaped to fit over lid portion 14. Ring 26 includes a lower face 28 which directly contacts flange portion 16. By depressing member 24 against flange portion 16 to engage lower face 28 therewith, friction can be created between the flange portion 16 and lower face 28 during rotation so that cap 10 can be easily removed or replaced. Preferably, the resilient material used to form member 24 is a material having a dull, non-glossy finish. Such a finish will further enhance the amount of friction created between the flange portion 16 and lower face 28.

Figure 5:
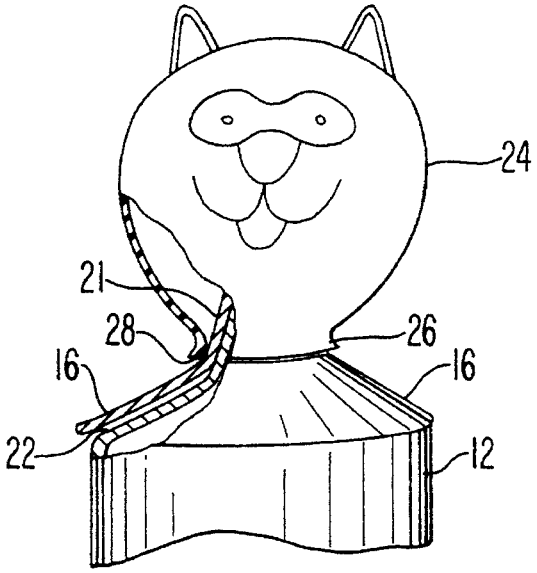
FIG. 5 is a partially cut-away cross sectional view of the cap of the present invention including a first embodiment of the rotational assistance member in a rest position.
Figure 6:
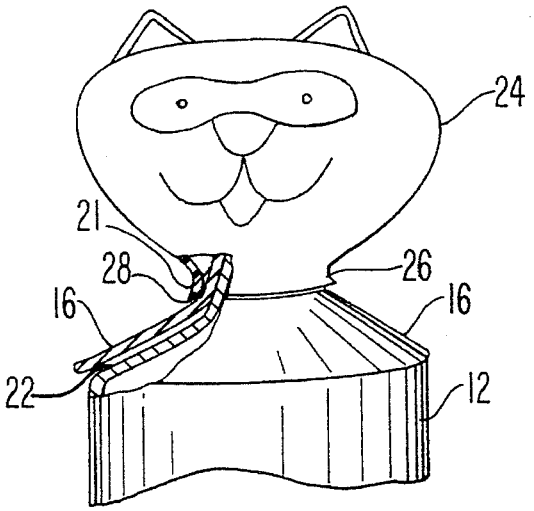
FIG. 6 is a partially cut-away cross sectional view of the cap of the present invention showing the first embodiment of the rotational assistance member in an engaged rotational position.
Figure 7:
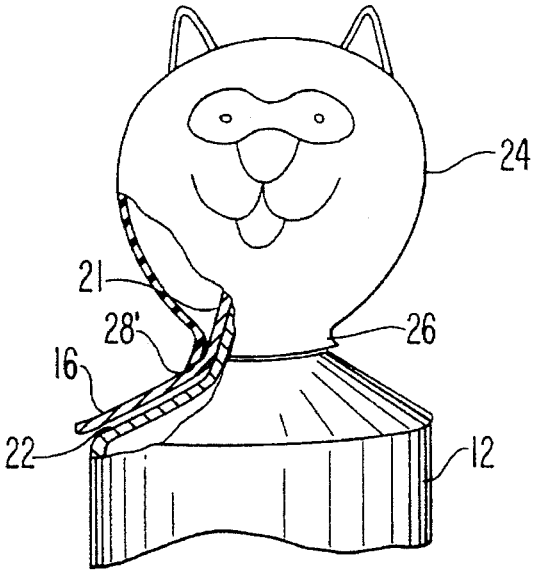
FIG. 7 is a partially cut-away cross sectional view of the cap of the present invention including a second embodiment of the rotational assistance member of the present invention in the rest position.

FIGS. 5–7 illustrate rotational assistance member 24 engaged with cap 10. Specifically, FIGS. 5 and 6 illustrate one embodiment of member 24 before and during rotation of cap 10, respectively. As shown in FIG. 5, lower face 28 of ring 26 extends in a direction substantially perpendicular with lid portion 14 in a rest position. As a result, lower face 28 does not fully contact flange portion 16 in this position.

During opening or closing of the dispenser, however, pressure is applied to rotational assistance member 24 which forces lower face 28 into frictional engagement with flange portion 16 to assist in rotating cap 10. Such a design reduces production cost associated with the formation of rotational assistance member 24 because lower face 28 is not required to be molded to conform with the angular dimensions of flange portion 16. Further, a more complete seal between the entire surface area of lower face 28 with flange portion 16 may be created since the seal is re-created each time. This avoids the necessity of molding ring 26 and lower face 28 to exactly match the dimensions of flange portion 16, and, thereby, reduces the high costs of exact molding.

FIG. 7 illustrates a second embodiment of the rotational assistance member 24 in which lower face 28 is formed to conform to the angular shape of flange portion 16, even in the rest position.

It is to be understood that the present invention is not limited only to the specific embodiments described above, but encompasses any and all embodiments within the scope of the following claim.

I claim:

1. A safety cap shaped to prevent choking for a dispenser including an upper surface region surrounding a central column, said upper surface extending away from said central column at a first obtuse angle, comprising:

a lid portion generally cylindrical in shape and having an upper portion and lower portion wherein said lower portion engages the central column of the dispenser;

attachment means located within said lid potion for securing the cap to the central column of the dispenser;

a frusto-conical flange potion located at said lower portion of said lid portion, said frusto-conical flange portion extending at a second obtuse angle with respect to said lid potion, wherein said first obtuse angle is substantially equal to said second obtuse angle of said flange portion; and a rotational assistance means attachable to said lid portion for frictionally engaging said flange portion of said cap, said rotational assistance means comprising a resilient material capable of causing friction between said rotational assistance means and said flange potion wherein said rotational assistance means includes a base ring portion which matingly receives said lid portion, said base ring portion including a lower face which engages said flange portion and extends away from said lid portion at an angle substantially equal to said second obtuse angle of said flange portion.

2. The safety cap of claim 1, wherein said frusto-conical flange portion extends radially over the entire upper surface region of said dispenser.

3. The safety cap of claim 2, wherein said flange portion extends radially and has a diameter of at least 1¼ inches.

4. The safety cap of claim 1, wherein said attachment means of said lid portion comprises internal threads formed on an internal wall of said lid portion to match external threads on said central column of said dispenser.

5. The safety cap of claim 1, wherein said rotational assistance means includes a bulbous head portion substantially larger than said lid portion and attached to said base ring portion for providing increased gripping area than provided by said lid portion alone.

6. The safety cap of claim 1, wherein said lower face which engages said flange portion extends away from said lid portion at an angle substantially perpendicular to said lid portion in a rest position, wherein said rotational assistance means is deformable by pressure applied in the direction of said dispenser to force said lower face into engagement with said flange portion in an engagement position.

7. The safety cap of claim 1, wherein said cap comprises a rigid material which is more rigid that the upper surface region of the dispenser to provide structural integrity to the dispenser.

* * * * *